12/22/87 XR 4,714,930

United States Patent [19]

Winter et al.

[11] Patent Number: 4,714,930

[45] Date of Patent: Dec. 22, 1987

[54] ANTENNA FEED POLARIZER

[75] Inventors: Trevor Winter, Maldon; William Macey, Brentwood, both of United Kingdom

[73] Assignee: The General Electric Company p.l.c., London, England

[21] Appl. No.: 901,374

[22] Filed: Aug. 28, 1986

[30] Foreign Application Priority Data

Oct. 3, 1985 [GB] United Kingdom ..... 8524396

[51] Int. Cl.[4] ..... H01Q 13/00

[52] U.S. Cl. ..... 343/786; 343/756; 343/763

[58] Field of Search ..... 343/786, 756, 763; 333/21 A; 242/54 A

[56] References Cited

U.S. PATENT DOCUMENTS

| | | | |
|---|---|---|---|
| 3,089,137 | 5/1963 | Pierce | 343/756 |
| 3,357,021 | 12/1967 | Allen | 343/756 |
| 3,394,375 | 7/1968 | Vice et al. | 343/756 |
| 3,604,009 | 9/1971 | Beach | 343/763 |

*Primary Examiner*—James W. Davie
*Assistant Examiner*—Hoanganh Le
*Attorney, Agent, or Firm*—Spencer & Frank

[57] ABSTRACT

This invention relates to rotatable antenna feed polarizers for use in communication antenna systems, and seeks to provide, at economic cost, an antenna feed polarizer which is capable of being rotated accurately.

The polarizer is rotated by a threaded member rotated by a motor. A drive member is moved longitudinally by the rotation of the threaded member. Two flexible connectors are each attached at one end to the drive member, pass around idler wheels, are wrapped partly around the polarizer, and are fixed to the latter. Movement of the drive member pulls one of the flexible connectors and thereby rotates the polarizer.

Backlash is minimal because it occurs between only two moving parts, the drive member and the elongate member, and is achieved without using gears with minimum backlash, which may be expensive.

6 Claims, 1 Drawing Figure

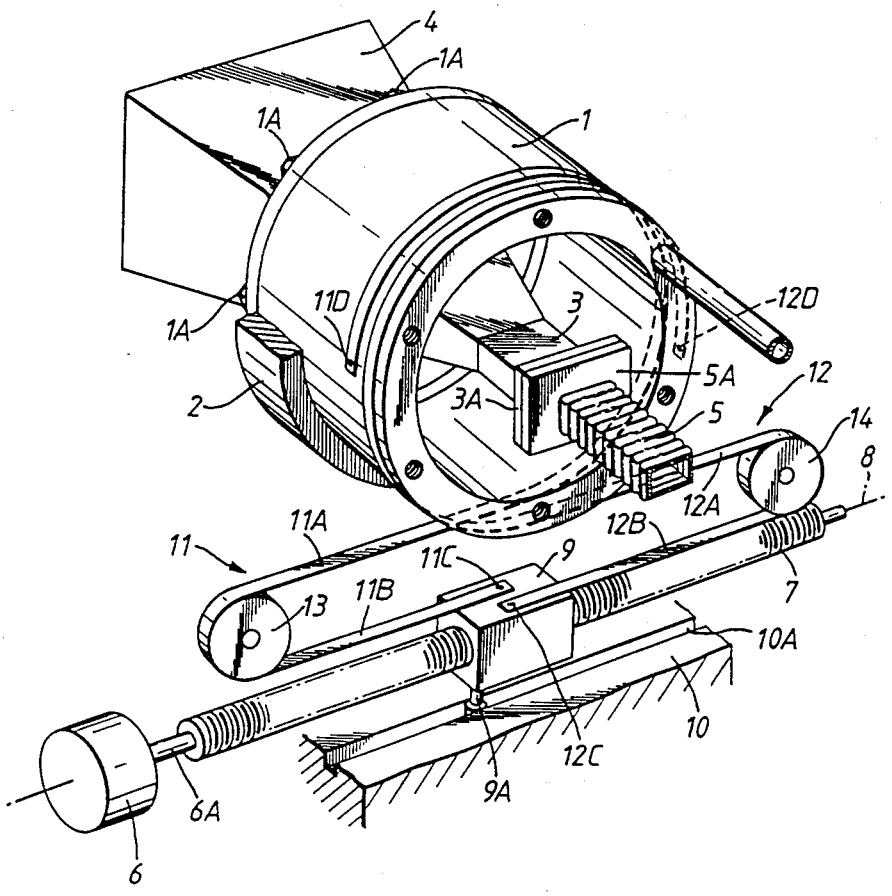
4
1A
1A
1
1A
11D
3
12D
5A
12
2
3A
5
14
8
12A
11A
12B
11
11C
9
7
13
11B
10A
10
12C
9A
6A
6

ANTENNA FEED POLARIZER

BACKGROUND OF THE INVENTION

This invention relates to a rotatable antenna feed polariser, and in particular to the means employed for rotating it.

In antenna systems, it is often required to include a polariser and it is sometimes necessary to change the direction of polarisation. For example, in a communication system, it may be necessary to select the direction of polarisation depending on the communication channel being used.

One known way by which this may be done is by means of a motor connected to the polariser via a speed reduction gearbox which is necessary to achieve sufficient accuracy of adjustment.

However, the amount and speed of rotation of the polariser cannot be controlled with complete accuracy because of stretching of the belt and backlash in the gearbox. Also, this known method can be expensive because of the cost of providing gears with minimal backlash.

BRIEF SUMMARY OF THE INVENTION

An object of the present invention is to provide, at economic cost, an antenna feed polariser which is capable of being rotated accurately.

According to this invention there is provided a rotatable antenna feed polariser comprising a motor, an elongate threaded member connected to be rotated about its longitudinal axis by the motor, a drive member which cooperates with the thread of the elongate member so as to be driven in the direction of the axis when the elongate member rotates, and a flexible connector attached to the drive member and wrapped at least partly around the polariser or around an element connected to the polariser so that the latter is caused to rotate when the motor operates.

It would be possible to use just a single run of flexible connector material extending from one end, attached to the drive member, to an opposite end attached to the polariser. This would however provide rotation in only one direction and it would be necessary to include additional means, such as a spring, to effect reverse rotation. In a preferred arrangement, reverse rotation is obtained by a second run of flexible connector material extending from the drive member to the polariser with at least one and preferably both of these runs passing around an idler between the drive member and the polariser.

The two "runs" can be provided by a single length of material extending from the drive member, around the polariser and back to the drive member. It is however desirable to secure the flexible connector material to the polariser positively i.e. other than by friction. This limits the maximum degree of rotation achievable by such an arrangement. For this reason the two runs preferably have separate ends fixed individually to the polariser. The fixing points are preferably spaced in the direction of the axis of the polariser so that the two lengths are wrapped around different parts thereof and do not interfere with each other. Attachment points of the two lengths to the drive member may be spaced similarly.

In a preferred arrangement each length of flexible material extends from the drive member, around an idler and then to a side of the polariser closest to the drive member before passing around the polariser. This arrangement enables the parts of each length of flexible material at either side of the idler to be parallel or more nearby so than if they passed in the opposite directions around the polariser. This is a significant advantage because it reduces the effect which inaccuracies in the polariser bearings (such as wear) have on the tension and/or required length of the flexible connector material.

Where two lengths of flexible connector are used they can in fact be made by a single length of material anchored at a point between its ends to the drive member and/or to the polariser.

BRIEF DESCRIPTION OF THE DRAWING

The single FIGURE of the drawing is a perspective view of an antenna feed polariser constructed according to this invention.

DETAILED DESCRIPTION OF THE PREFERRED EMBODIMENT

A cylinder 1, supported in a bearing 2, for rotation about its axis, receives a polarising feed 3 attached to a feed horn 4. During assembly the feed 3 is slid into the cylinder 1 and secured thereto e.g. by bolts 1A. This enables a single design of cylinder 1 to be used with a selection of different components 2 and 3. The bearing 2 of the cylinder 1 is held on a main frame (not shown) which supports all the illustrated mechanism and holds it together. In use energy is fed to the polarising feed 3 via a flexible and twistable waveguide 5 secured to the feed 3 by flanges 3A & 5A. The output shaft 6A of a motor 6 is connected to an elongate threaded member 7 in such a way that the threaded member 7 is caused to rotate about its longitudinal axis 8 by the motor 6. A drive member 9 carries a guide pin 9A which is guided in a slot 10A formed in a guide member 10 held in the main frame. The co-operation between the pin 9A and the slot 10A prevents the member 9 from rotating whilst allowing it to be driven in the direction of the axis 8 when the elongate member 7 rotates. Two flexible connectors 11 and 12 are attached to the drive member 9, pass around respective adjustable tensioning idler wheels 13 and 14, and are wrapped in opposite senses partly around the cylinder 1.

It is to be noted that the runs 11A and 12A of flexible material extending from the idlers 13 and 14 to the cylinder 1 first make contact with the latter in its lowermost side and that the arrangement of the cylinder 1 is such that these runs 11A, 12A are substantially parallel to the runs 11B and 12B between the drive member 9 and the idlers. This makes the tension in the flexible connectors less affected by changes in the vertical position of the cylinder 1 than would be the case if the runs 11A and 12A passed in the opposite directions around the cylinder 1.

It is also to be noted that the points 11D and 12D where the flexible connectors are attached to the cylinder 1 are spaced, not only circumferentially around the cylinder, but also in the direction of its axis. Similarly the points 11C and 12C where the flexible connectors are attached to the drive member 9 are spaced in this same direction. This allows the flexible connectors 11 and 12 to occupy different parts of the cylinder 1 and avoids rubbing of one against the other.

In operation the motor 6 causes the elongate member 7 to rotate about its axis 8, which results in the drive member 9 moving in the direction of this axis. This, in turn, pulls on one of the flexible connectors 11 or 12 and hence the horn 4 and polariser 3 rotates, such rotation being accommodated by the flexibility of the waveguide 5. At the same time, slack in the other flexible connector is taken up by the movement of the drive member 8.

We claim:

1. A rotatable antenna feed polariser comprising a motor (6), an elongate threaded member (7) connected to be rotated about its longitudinal axis (8) by said motor (6), a drive member (9) which co-operates with the thread of said elongate member (7) so as to be driven in the direction of said axis (8) when said elongate member (7) rotates, and a flexible connector (11,12) attached to said drive member (9) and wrapped at least partly around said polariser (3) or around an element (1) connected to said polariser (3) whereby said polariser is caused to rotate when the motor (6) operates.

2. A rotatable polariser according to claim 1 wherein there are two flexible connectors (11,12) attached to the drive member (9), and wrapped in opposite senses to each other at least partly around the polariser (3) or the element (1) connected to the polariser (3).

3. A rotatable polariser according to claim 1 comprising means (9A) to prevent the drive member (9) from rotating.

4. A rotatable polariser according to claim 1 wherein the flexible connector (11,12) passes around tensioning means (13,14).

5. A rotatable polariser according to claim 2 comprising means (9A) to prevent the drive member (9) from rotating.

6. A rotatable polariser according to claim 2 wherein each flexible connector (11,12) passes around tensioning means (13,14).

* * * * *